United States Patent [19]

Powers

[11] 4,109,588

[45] Aug. 29, 1978

[54] ADJUSTABLE HEIGHT TABLE

[76] Inventor: Richard J. Powers, 3622 Milford Mill Rd., Baltimore, Md. 21207

[21] Appl. No.: 850,635

[22] Filed: Nov. 11, 1977

[51] Int. Cl.[2] ..... A47B 85/00

[52] U.S. Cl. ..... 108/12; 108/144; 108/159

[58] Field of Search ..... 108/11, 12, 19, 116, 108/115, 144, 145, 159, 128, 160, 106, 153; 248/157, 421

[56] References Cited

U.S. PATENT DOCUMENTS

| | | | |
|---|---|---|---|
| 2,235,290 | 3/1941 | Exline et al. | 108/159 |
| 2,253,777 | 8/1941 | Gipson | 108/12 |
| 2,628,668 | 2/1953 | Basile | 108/159 |
| 2,636,794 | 4/1953 | Sternkopf | 108/19 |
| 3,967,562 | 7/1976 | Anacker | 108/12 |

FOREIGN PATENT DOCUMENTS

| | | | |
|---|---|---|---|
| 1,043,962 | 11/1953 | France | 108/144 |

*Primary Examiner*—Roy D. Frazier
*Assistant Examiner*—Peter A. Aschenbrenner
*Attorney, Agent, or Firm*—Fidelman, Wolffe, & Waldron

[57] ABSTRACT

A table is provided which is adjustable between a lower and an upper height. The table top rests on supporting members attached to extension arms which are pivotally mounted to the table legs. The extension arms may be rotated from horizontal to vertical and provide with the supporting members a lower table top height when in the horizontal position and an upper table top height when in the vertical position.

8 Claims, 8 Drawing Figures

ADJUSTABLE HEIGHT TABLE

BACKGROUND OF THE INVENTION

1. Field of the Invention

This invention relates to tables which are convertible between two heights. In one mode the table top may be positioned at a low height and is suitable for use as a cocktail table. In the second mode, the table top may be positioned at dining table height.

2. Description of the Prior Art

It has long been recognized in table construction that adjustable height tables offer the advantages of efficient space utilization, economy and convenience. In spite of these obvious advantages, there has been a dearth of acceptable and practical designs. Many of the adjustable height tables of the prior art are cumbersome in operation, unattractive in appearance, awkwardly proportioned and unduly complex.

Patents considered representative of the prior art include U.S. Pat. No. 3,738,286 which discloses an adjustable height table having pivotally mounted legs upon which the table top rests. Height adjustment is achieved by rotating each of the legs thus changing its effective length. U.S. Pat. No. 2,635,023 describes a convertible furniture base which may be turned 90° to provide two different table heights. Finally, Gipson in U.S. Pat. No. 2,253,777 discloses a table which has a base frame having bearing pins riding in a slotted member attached to the bottom of the table top. A quarter-turn of the base frame relative to both the table top and the floor changes the effective height of the base frame.

SUMMARY OF THE INVENTION

A table which is adjustable between a relatively low height and a normal dining height is provided with a pair of interlocking leg members having extender members pivotally attached thereto. In the lower position, the extender members rest on the upper surface of the leg members and simultaneously provide support means for a table top. The extender members are pivoted upward and held in place with a key means to form a support surface for a table top in the upper position.

Hence, it is an object of this invention to provide a table which is adjustable between a lower and an upper height.

It is another object of this invention to provide a stable support means for a table top which is adjustable between two heights.

A specific object of this invention is to provide a table easily convertable between cocktail and dining use.

DETAILED DESCRIPTION OF THE INVENTION

Figure 1:
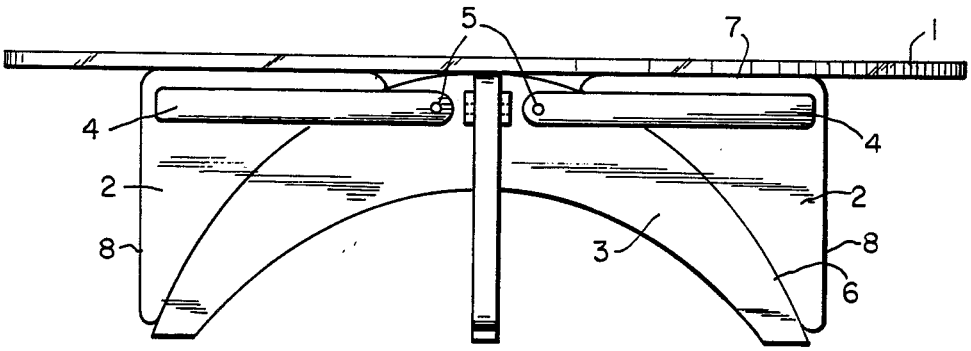
FIG. 1 is a side elevational view of the table in a lowered position.
Figure 2:
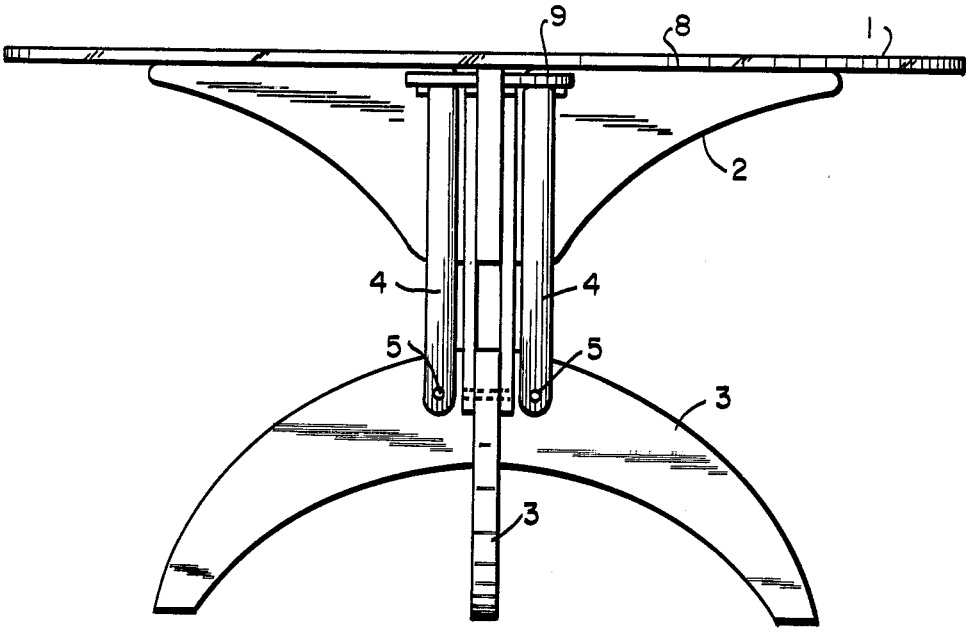
FIG. 2 is a side elevation view of the table in a raised or upper position.

FIGS. 1 and 2 show the table of this invention in its lower and its upper position respectively. As illustrated in these Figures, a table top 1 rests upon and is supported by table top support member 2. Member 2 is pivotally attached to legs 3 by extender arms 4 which are fixedly attached to support member 2 and pivot about pin or bearing 5 which is located near the center of the leg member.

As shown in FIG. 1, the table is positioned at its lower level by pivoting support members 2 downwardly to rest upon an upper surface 6 of leg members 3. Surfaces 7 of support members 2 thus provide a framework to hold table top 1 in a plane horizontal position.

Figure 7:
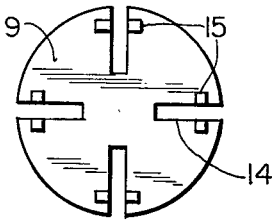
FIG. 7 is a bottom plan view of the key member.

Rotation of the extender arms 4 over 90° upwardly, as shown in FIG. 2, brings surfaces 8 of support members 2 into an upper plane horizontal position to provide support for the table top at dining height. The extender arms 4 are locked into a vertical position by retainer or key 9 which is shown in more detail in FIGS. 5 and 7.

Figure 3:
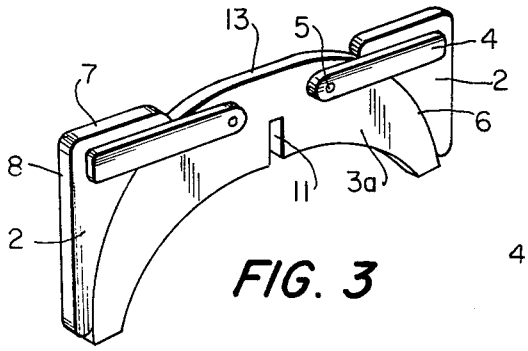
FIG. 3 is a top perspective view of one of the leg members.
Figure 4:
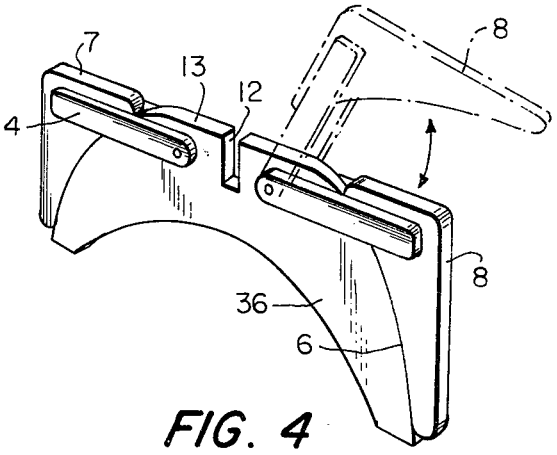
FIG. 4 is a top perspective view of the other leg member.

FIGS. 3 and 4 illustrate in more detail the construction and operation of the legs, extender arms and table top support members. The table legs comprise two leg members 3*a* and 3*b* which preferably are identical in size and shape except for a notch or groove 11 in the bottom center of member 3*a* and a mating notch or groove 12 in the top center of member 3*b*. The two leg members are interlocked at right angles by means of the mating notchs 11 and 12. A portion of the top surface 13 of each leg member is preferably flat and horizontal in attitude to provide support for the table top.

The upper, outer surface 6 of the leg members is preferably arcuate, curved or tapered in an esthetically pleasing fashion and the corresponding surfaces of the table top support members 2 conform in shape so as to nest upon the legs when the table is in its lower position. When the support members 2 are nested upon the legs, surfaces 7 lie flat and parallel to leg surface 13 thus providing extended support for the table top.

Pivoting the extender arms 4 upwardly into a vertical position, as shown in dotted outline in FIG. 4, brings surfaces 8 of support members 2 into a horizontal plane thus providing support means for the table top at an upper height. Surfaces 7 and 8 of member 2 thus are disposed at right angles to each other.

Figure 5:
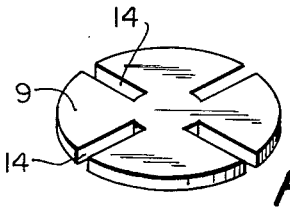
FIG. 5 is a top perspective view of the key member.
Figure 6:
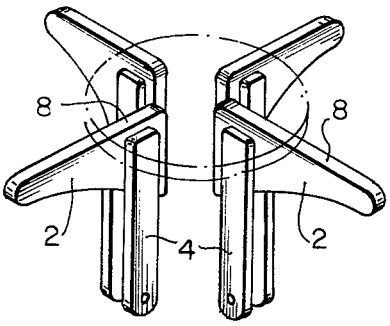
FIG. 6 is a top perspective view of the extender members in their upper position.

FIG. 5 shows key 9 in more detail and, in combination with FIG. 6, illustrates the interaction of key 9 with extender arms 4 to lock those arms in a vertical position. As shown in FIG. 6, which is a partial break away drawing of the extender arms and table top support members disposed in an upper position, arms 4 terminate short of surfaces 8 of members 2 thus providing a rest or stop for key 9.

Key 9 preferably comprises a circular plate having four slots 14 disposed at right angles and extending from the circumference inwardly to a point short of the center. Slots 14 are sized to provide a mating fit with support members 2 and provide lateral stability to those members when they are in the raised or upper position as is shown in dotted outline in FIG. 6. The underside of key 9 is provided with locking blocks 15, illustrated in FIG. 7, which hold extender arms 4 in a vertical position and prevent those arms from falling downwardly when the table top is removed. It is to be noted that key 9 is employed only when the table is locked in its upper position.

Figure 8:
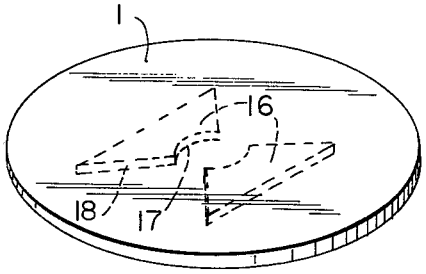
FIG. 8 is a top perspective view of the table top showing positioning blocks.

FIG. 8 illustrates an optional embodiment of the table top 1. In this embodiment, a pair of locating blocks 16 are fixedly attached to the underside of table top 1. Blocks 16 preferably comprise triangular members having an arcuately truncated inner face 17 which provides a mating fit with the circumferential face of key 9. Sides 18 of block 16, adjacent to arcuate face 17, parallel surfaces 8 of support members 2 and thus maintain the table top in a fixed, centered position. It is preferred that this embodiment be used with table tops of wood or laminate construction. Use of locating blocks 16 in conjunction with glass table tops is not favored as they detract from the visual appearance of the table and are unnecessary due to the weight of the glass top.

As has been noted, the table top may be constructed of glass, wood, laminates or other conventional materials. Likewise, the legs, extender arms and table top support members may be constructed of any appropriate material but wood or wood laminates are preferred primarily for reasons of appearance.

It will be obvious that the upper and lower table height and the ratio betwen the two heights may be adjusted by appropriate dimensional changes. Likewise, the non-functional dimensions of the various component parts may be varied to give a wide variety of pleasing contours and shapes.

While the table of this invention has been described as having a pair of interlocking leg members and four table top support members, it is possible although much less preferred to provide three or even four leg members and either six or eight support members respectively. Similar modifications will be apparent to these skilled in the art and fall within the scope of the described invention.

I claim:

1. A table adjustable between a lower and an upper position which comprises:

a table top;

a plurality of interlocking leg members having a maximum height equal to the table top height at its lower position;

a plurality of table top support members, each of said support members having a first support surface upon which the table top rests when in its lower position and a second support surface disposed at a right angle to said first surface, said table top resting upon said second support surface when in its upper position;

arm members fixedly connected to said support members and pivotally connected to said leg members and adapted to pivot through a 90° arc whereby there is provided support means for said table top in a lower and an upper position.

2. The table of claim 1 wherein a pair of leg members are interlocked at right angles one to the other.

3. The table of claim 2 wherein retainer means are provided to restrain the pivotal movement of the arm members when the table is in its upper position.

4. The table of claim 3 wherein the retainer means comprises a circular plate having slots therein mating with said support members and resting upon the ends of the arm members.

5. The table of claim 4 wherein the retainer means further includes blocks positioned adjacent said slots and adapted to prevent rotational movement of said arms.

6. The table of claim 2 wherein said support members are generally triangular in shape, two sides of the triangle being formed by said first and second support surfaces and the third side being generally arcuate and nesting upon an upper surface of said leg members when the table is in its lower position.

7. The table of claim 4 wherein at least two locating blocks are fixedly attached to the underside of said table top.

8. The table of claim 7 wherein said locating blocks comprise triangular members having an arcuately truncated inner face providing a mating fit with the circumferential face of said circular plate.

* * * * *